US007549639B2

(12) United States Patent
Martineau

(10) Patent No.: US 7,549,639 B2
(45) Date of Patent: Jun. 23, 2009

(54) VARIETIES OF HUMAN EXPERIENCES BOARD GAME

(76) Inventor: Bolivar Philippe Martineau, P.O. Box 48576, Tampa, FL (US) 33647

( * ) Notice: Subject to any disclaimer, the term of this patent is extended or adjusted under 35 U.S.C. 154(b) by 0 days.

(21) Appl. No.: 11/799,635

(22) Filed: May 1, 2007

(65) Prior Publication Data

US 2008/0272543 A1 Nov. 6, 2008

(51) Int. Cl.
*A63F 3/00* (2006.01)

(52) U.S. Cl. ..... 273/242; 273/243

(58) Field of Classification Search ..... 273/243, 273/242; D21/363

See application file for complete search history.

(56) References Cited

U.S. PATENT DOCUMENTS

| | | | | |
|---|---|---|---|---|
| 4,189,153 | A * | 2/1980 | Zollinger | 273/256 |
| 5,280,914 | A * | 1/1994 | Selby et al. | 273/287 |
| 6,224,056 | B1 * | 5/2001 | Jones | 273/249 |
| 6,394,454 | B1 * | 5/2002 | Etherington et al. | 273/243 |
| 6,527,272 | B1 * | 3/2003 | Conner | 273/243 |
| 6,634,642 | B1 * | 10/2003 | Leon | 273/257 |

* cited by examiner

*Primary Examiner*—Vishu K. Mendiratta

(57) ABSTRACT

The variety human experiences board game provides the player with real life experiences such as confrontations against other players as well with the inevitable elements of nature. The game creates a greater awareness about the complexities of modern living, and how interdependent we are with our environment.

9 Claims, 8 Drawing Sheets

6

| Wisdom |
| --- |
| Winning can be defined as being totally prepared George Allen 1968 |
| GO TO ORACLE |

7

| Wisdom |
| --- |
| We must see to it that enthusiasm for the future does not give contempt for the past Pole Paul VI 1970 |
| Lose 3,000 |

8

| Wisdom |
| --- |
| Extreme Law is sometimes extreme injustice Terence Afer 190 BCE |
| Lose $3,000 |

9

| ANCESTRAL |
| --- |
| The road up and the road down is one and the same |
| Lose 2,000 |

Fig. 13a
10a
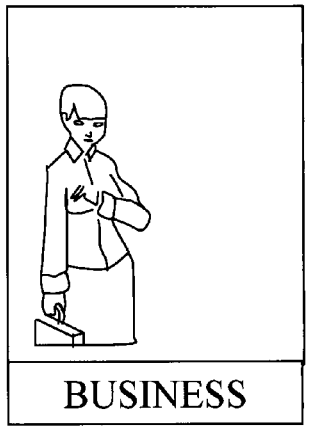
VOICES
Every young man should have a hobby, making money is the best one
J. Hurley 1962
Lose $2,000
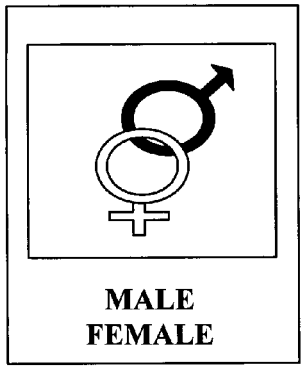
WISDOM
Let your life being sincere
Aristophanes 400 BCE
Go to VIP
Fig. 13b
10b
Fig. 13c
10c
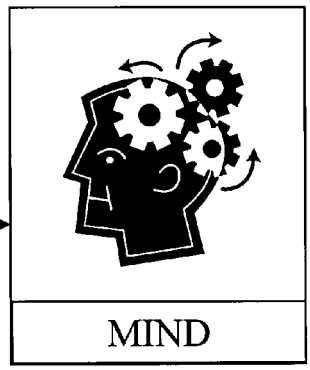
ANCESTRAL
Learning without thought is labor lost.
Confucius 500 BCE
Lose 3,000

10d
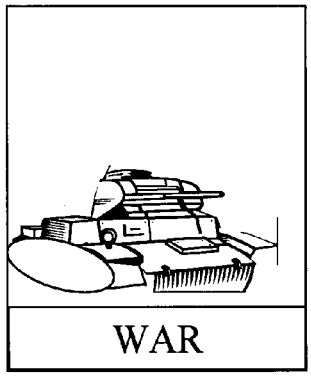
Lessons
Often an entire city suffer because of an evil man
Hesoid 700 BCE
Lose $1,000
Fig. 13d
Fig. 13e
10e
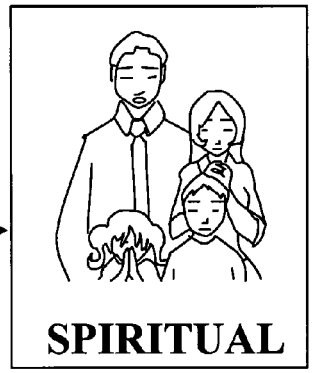
VOICES
Everyman, at one time or another is an Evangelist
J. Green 1960
Win $3,000
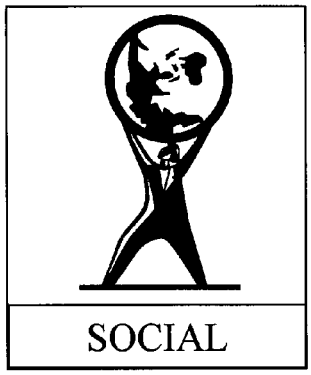
ANCESTRAL
No act of kindness is ever wasted.
AESOP 500 BCE
Win 2,000
10f
Fig. 13f

VARIETIES OF HUMAN EXPERIENCES BOARD GAME

STATEMENT REGARDING FEDERALLY SPONSORED RESEARCH AND DEVELOPMENT

N/A

RELATED APPLICATIONS

N/A

BACKGROUND OF THE INVENTION

1. Field of the Invention

The present invention relates generally to board games and more specifically it relates to a competitive board game which exhibits some problematic areas to which humans are exposed and creates awareness of the social class hierarchy.

2. Discussion of the Background

Various board games have been designed to educate the players by using human experiences and situations such as immigration, financial situations and politics.

An example is U.S. Pat. No. 6,634,642 to which discloses a board game that deals with the struggle an immigrant has to go through in order to live and seek the American dream. The game shows in a fun way the risks, choices and options an immigrant has to affront when he/she immigrates to the United States. It presents different legal classes such as illegal, tourist, parole, political refugee, resident and professional visa.

Another board game with educational purposes which deals with human experiences such as financial problems and child education corresponds to U.S. Pat. No. 6,106,300 issued to Kiyosaki. The patent teaches fundamental aspects of personal finance, investing and accounting to children.

There has always been a SOCIAL CLASS hierarchy in the United States. It is an open secret that few have cared to acknowledge. It is also a known fact that the priorities of the very Rich are not the same as those of the Poor.

Most people in the U.S. usually place themselves in the "Comfortable MIDDLE CLASS", working for a living, with money problems, but "living well".

All the mentioned board games may be suitable for particular purposes such as immigration, money and financial concepts. However the present invention is not limited by money and financial concepts because it shows how social classes interact by making alliances and fulfilling their own obligations in order to survive. Each social class has to deal with different problems in the path of life wherein the concerns and responsibilities of a particular class are not the same as the others. The present invention also shows how nature is blind with respect to social classes.

SUMMARY OF THE INVENTION

The present board game goes beyond financial, politics and immigration problems or situations; it combines human experiences and conflicts with their social class. There has always been a social class hierarchy in the United States, wherein a few have cared to acknowledge and wherein the priorities of a higher class are not the same as the lower class. The present board game exhibits the problematic areas to which humans and especially the social classes are exposed. It expresses the competitive nature with each other and delineates the human organism's confrontation with the elements of Nature, with his man-made creation, and with his own inner turmoil.

The game comprises a board, a set of dice, players' figures representation, chips and several groups of cards. Each player figure represents a social class status and starts with certain amount of chips as money representation depending on the social class. The players move across the board game track or path looking to improve their social class while encountering situations or problems and at the same time being chases by another player of a higher social class wherein the object of the game is to survive and meet or fulfill their social obligations and responsibilities. The BIG FISH tries to eat the LITTLE FISH and the LITTLE FISH tries to escape from the BIG FISH. The HIGHER SOCIAL STATUS Citizen represents brawn in the form of size, strength, status, money and power. The LOWER SOCIAL STATUS player represents brains in the form of "street smarts", swiftness, knowledge, expertise and flexibility.

Another object of the present invention is the acknowledgement and awareness of Social Class Systems in the United States.

Another object of the present invention is to entertain while teaching how strength, size and brawn compete against speed, stealth and smarts. It is the biological and social dominance in the evolutionary process of "Survival of the Fittest".

Another object of the present invention is to show the advantages of teaming up and alliances.

Another object of the present invention is to teach the players to be one step ahead of our competitors, whoever they may be.

Another object of the present invention is to show how interdependent we are with our environment and the complexities of Modern Living.

The invention itself, both as to its configuration and its mode of operation will be best understood, and additional objects and advantages thereof will become apparent, by the following detailed description of a preferred embodiment taken in conjunction with the accompanying drawing.

When the word "invention" is used in this specification, the word "invention" includes "inventions", that is, the plural of "invention". By stating "invention", the Applicant does not in any way admit that the present application does not include more the one patentable and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

FIG. 13*a*-13*f* represents the PANDORAS cards.

DESCRIPTION OF THE PREFERRED EMBODIMENT

The present board game invention is suitable for 1 or more players and, as shown in FIGS. 1-13, comprises a board game 1, player's representation figures, a set of dice, several card groups 6-12, a power factor cube and chips. The players' figures are shaped in representation of diversified objects depending of the level, for example social classes. For example, the social classes are represented by chest figures; wherein the pawn represents the lowest class and the king represent the highest class. Six different social classes are disclosed in the present invention because the United States hierarchy system is usually defined by six classes however the number of social classes may vary. The Social Stratification has been classified as follows:

Social Status

I—Welfare and Food stamps

II—The Lower Middle Class

III—The Upper Middle Class

IV—Professionals and Entrepreneurs

V—The Nouveau Riche and other Millionaires

VI—The Billionaires, the "Four Hundred Club," and The "Rich and Famous"

Figure 1:
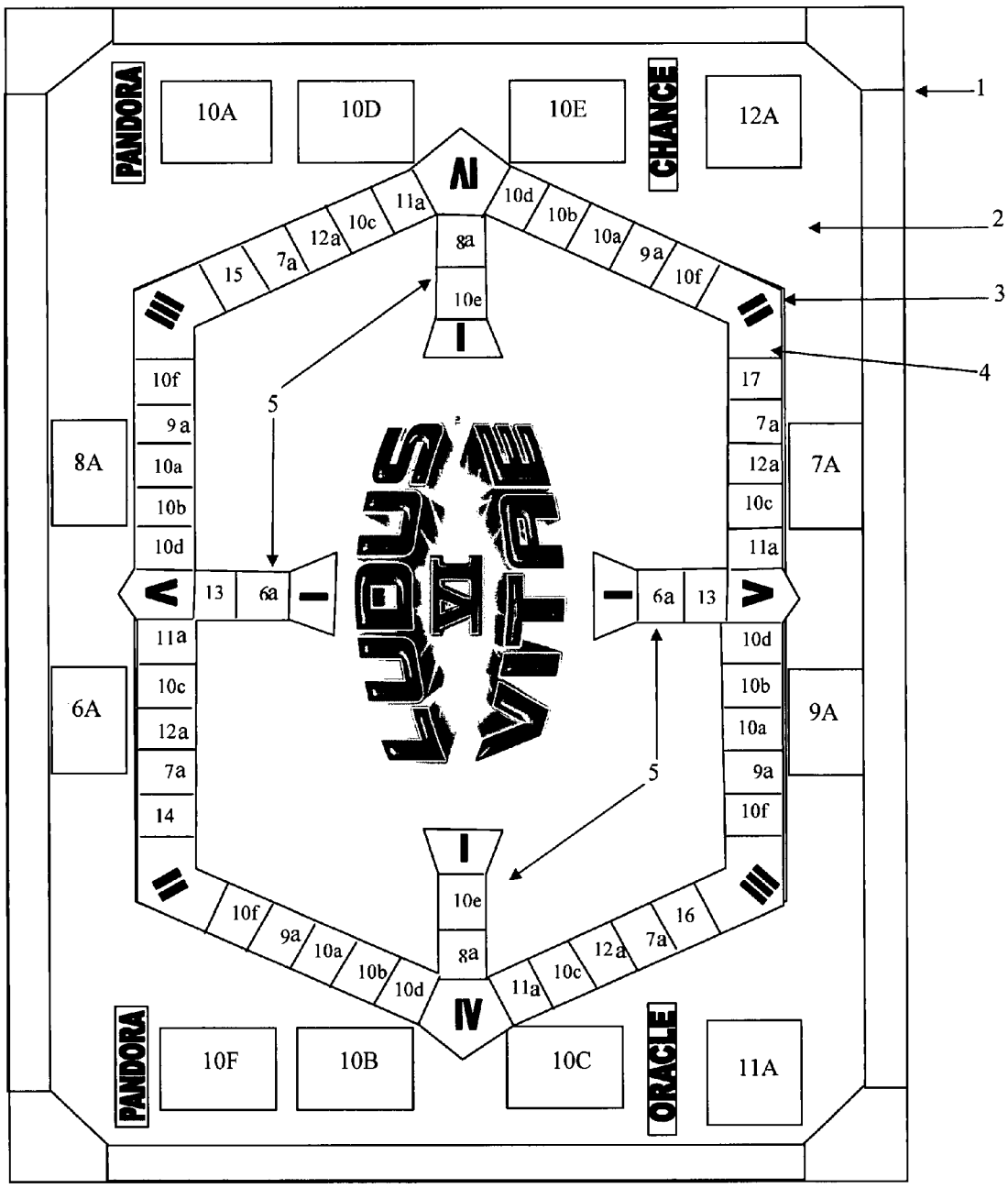
FIG. 1 is a top view of the board game design of the present invention.

The board game 1, as shown on FIG. 1, comprises an enclosed track 3 and a board outer section 2 for placing several card groups 6-12. The board outer section 2 for placing the cards 6-12 is located at the outer boundaries of the track 3. The cards' groups 6-12 are placed on the board outer section 2 wherein each group is distinct from each other and have their own mean and purpose. Each card group represents a conflict area or obstacle humans must confront and overcome in order to survive on a daily basis. On the instant case the card groups 6-12 are separated in four different main groups. The first group is called Pandora's cards 10. The Pandora's cards are divided into six different subgroups. The subgroups are WAR 10D, BUSINESS 10A, MALE-FEMALE 10B, SOCIAL 10F, MIND 10C and SPIRITUAL 10E. The second group is called Ludus' cards 6-9 and is divided in four subgroups: JUSTICE 8, SCIENCE 7, NATURE 9 and VIP 6. The third group is called ORACLE 11 and the fourth group is CHANCE 12. Groups and subgroups may be added or removed.

Figure 2:
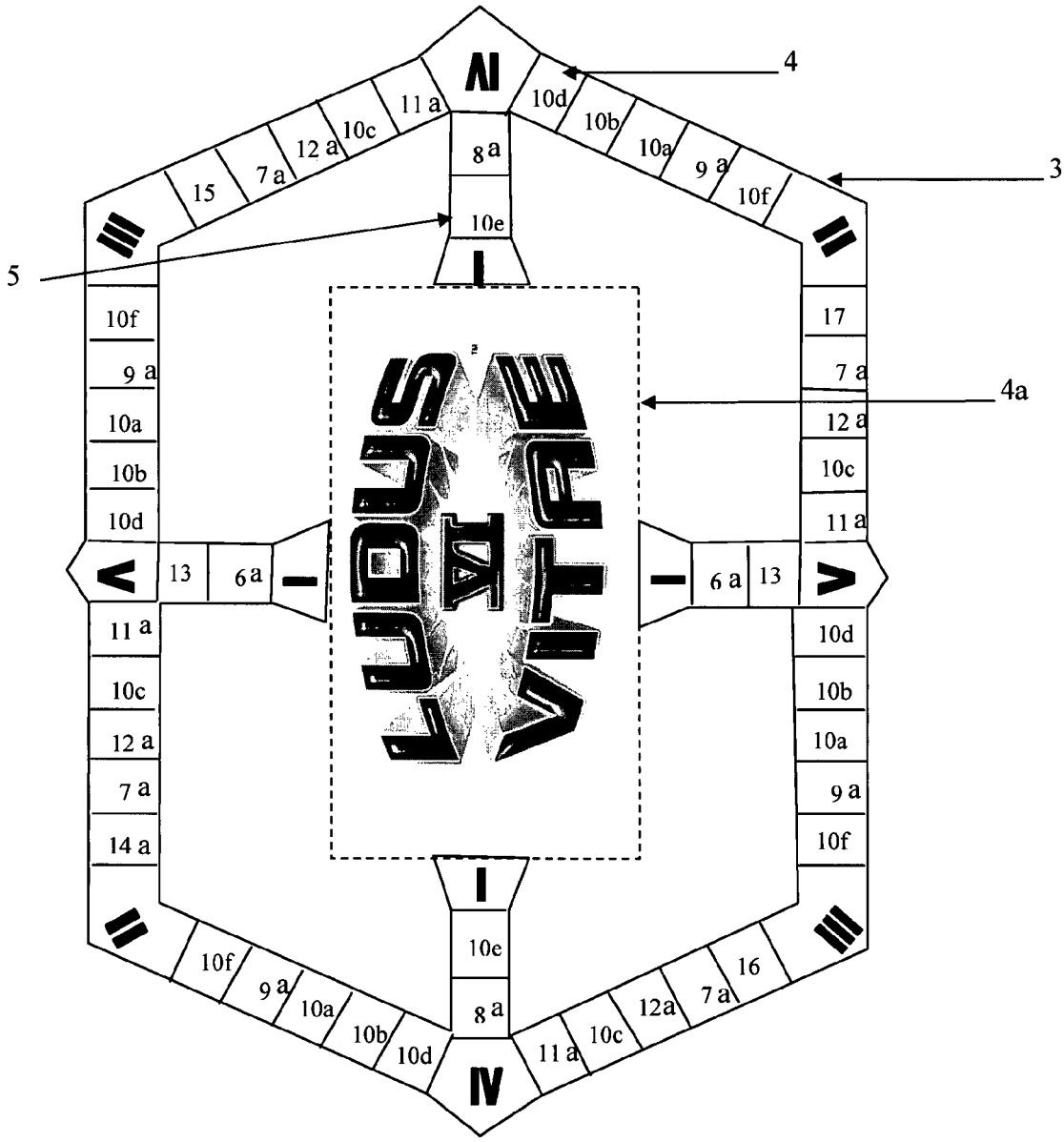
FIG. 2 is a view of the outer track and inner accesses
Figure 3:
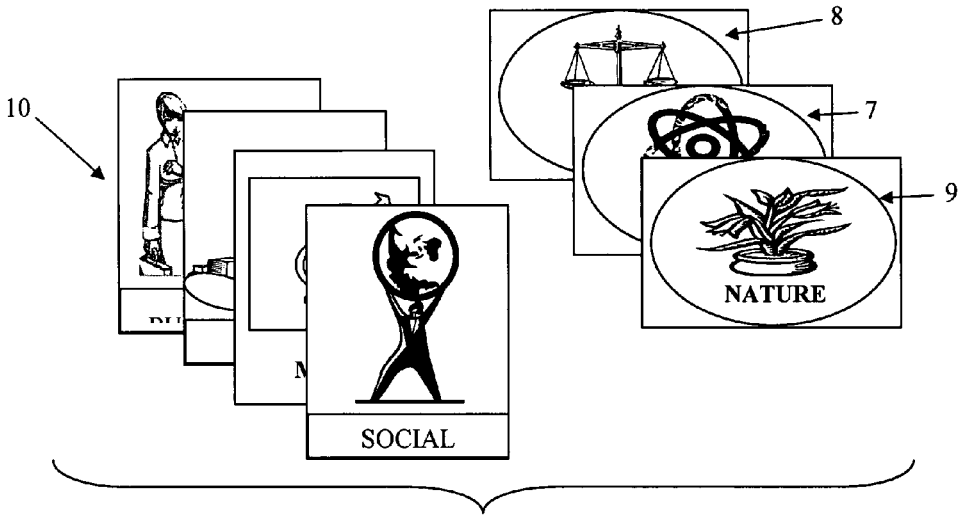
FIG. 3 represents some of the group card
Figure 4:
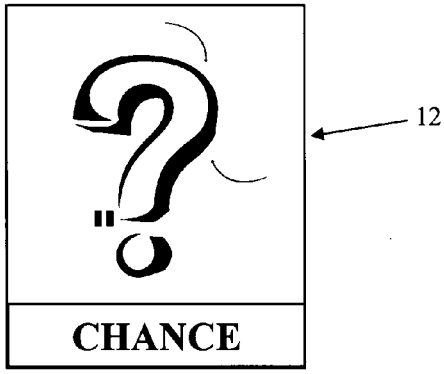
FIG. 4 shows CHANCE card group.
Figure 5:
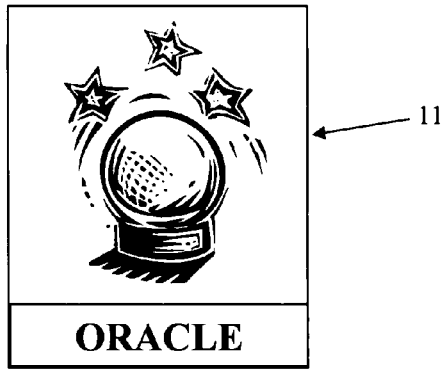
FIG. 5 shows ORACLE card group.
Figure 6:
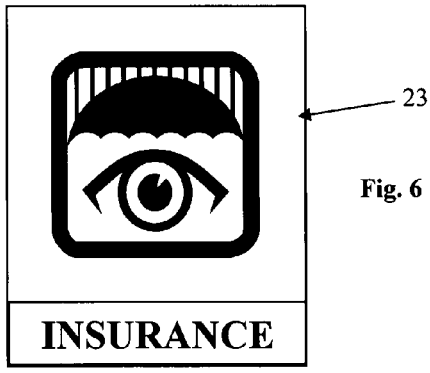
FIG. 6 represents the INSURANCE card.
Figure 7:
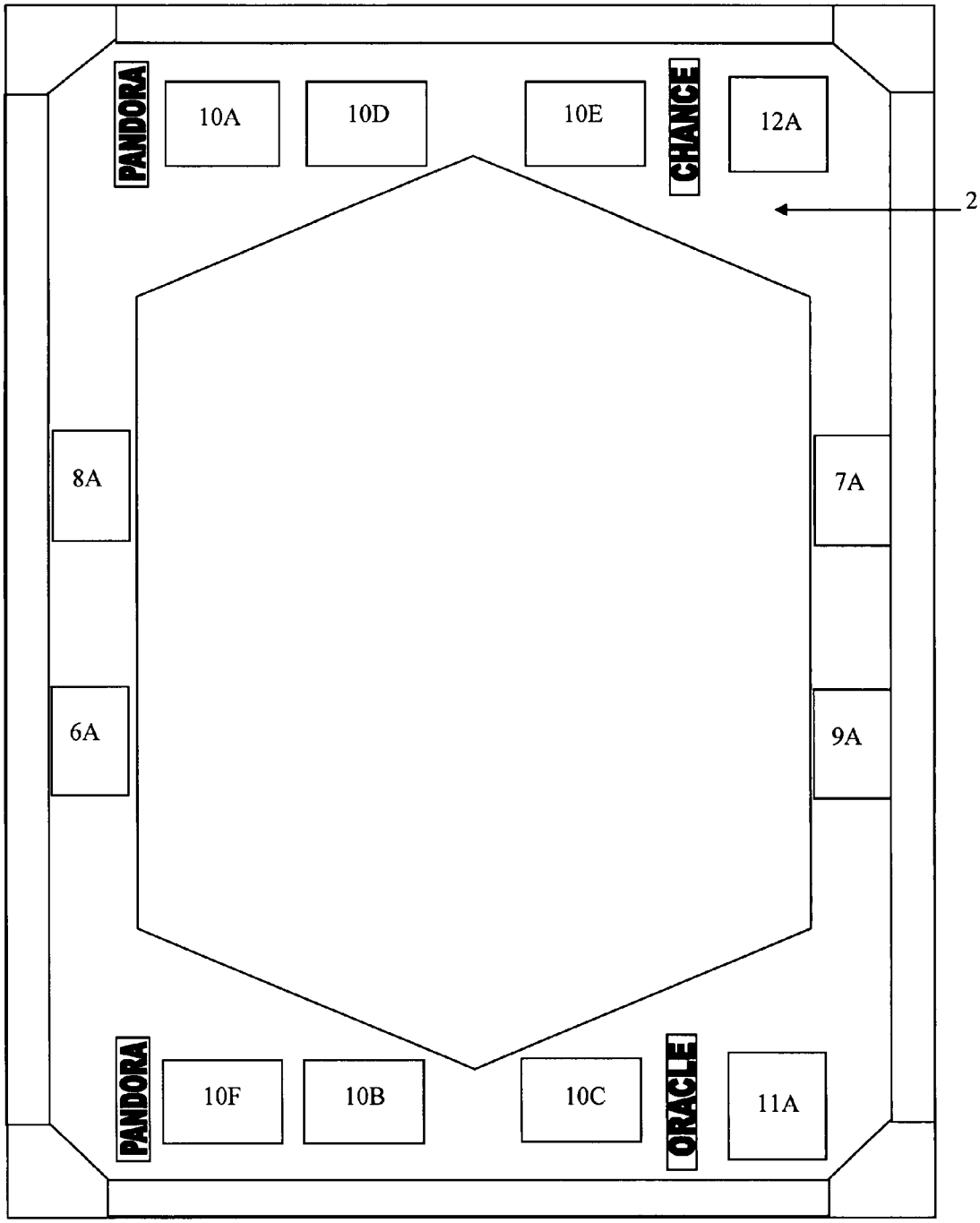
FIG. 7 is a view of the board game outer section.
Figure 8:
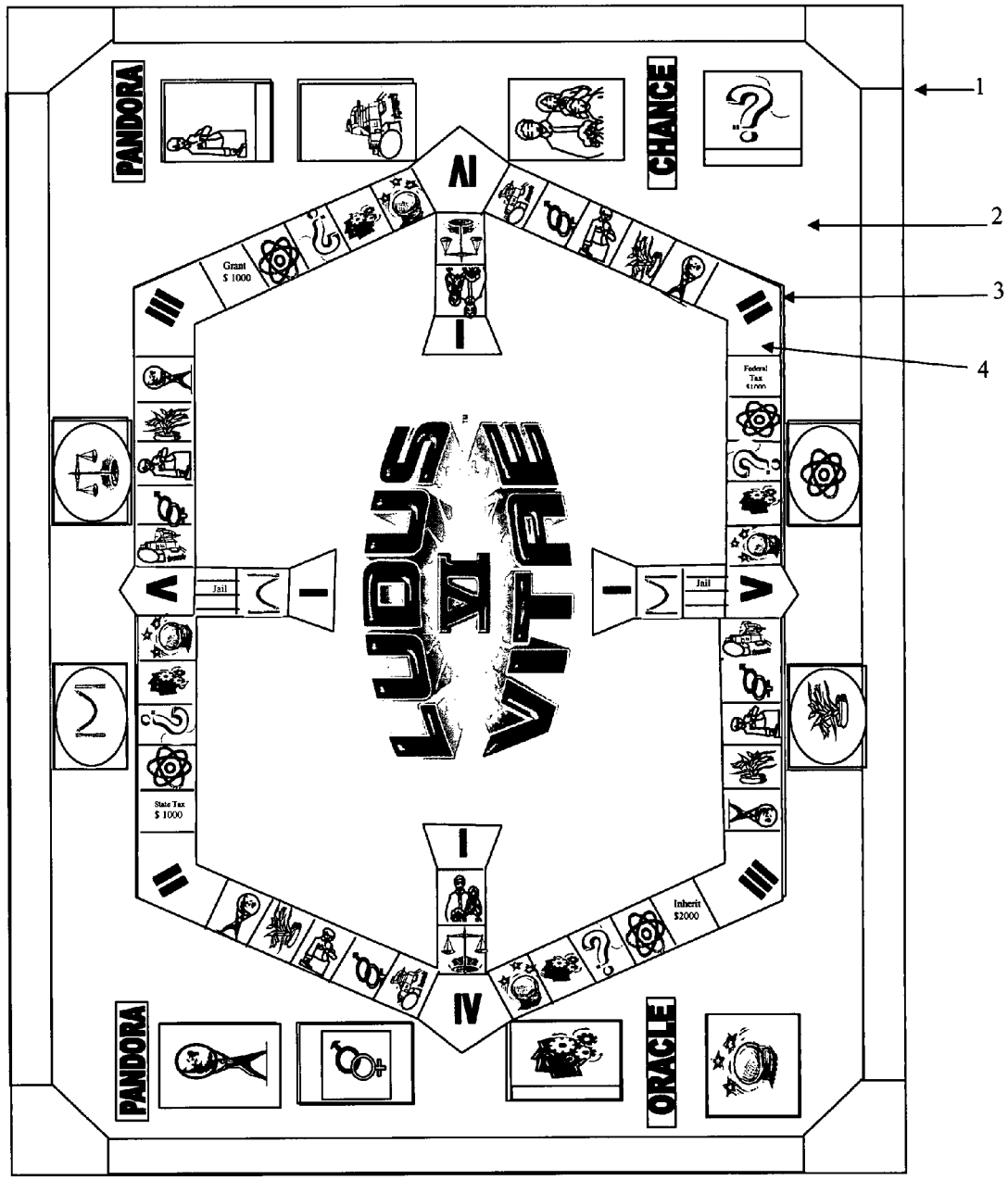
FIG. 8 is a top view of the board game design of the present invention.
Figure 9:
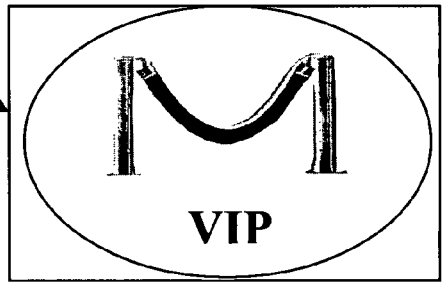
FIG. 9 represents the VIP cards.
Figure 10:
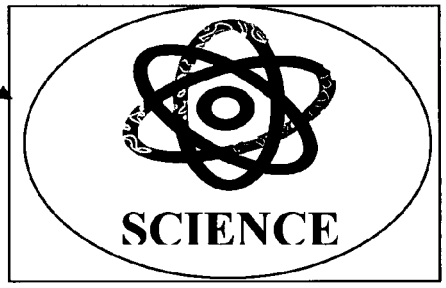
FIG. 10 represents the SCIENCE cards.

The track 3, as shown in FIG. 2, has several contiguous segments 4 defining playing positions, wherein each segment 4 shows at least one of the followings:

a social class status, instructions or a card group representation 6*a*-12*a*.

Different card group representations 6*a*-12*a* can be used such as images, colors or numbers as long they can be related to one of the card groups 6-12 on the outer board section 2. In the instant case images are used for an easier and more attractive way to relate the card representation with the card groups 6-12. Track 3 is provided with inner track accesses 5. The inner track accesses 5 extend from a center point 4*a* inside the track 3 toward the inner boundaries of track 3 in order to provide an alternative path. The inner track accesses 5 also comprise several segments 4 with at least one of the shows mention above. A hexagonal shape was selected for track 3 in order to provide a shape having at least two segments 4 of the track 3 showing twice the classes II, III, IV and V; wherein an equal number of segments 4 are aligned between them. Any other shape can be used but the hexagonal shape is more efficient for the present invention.

Figure 11:
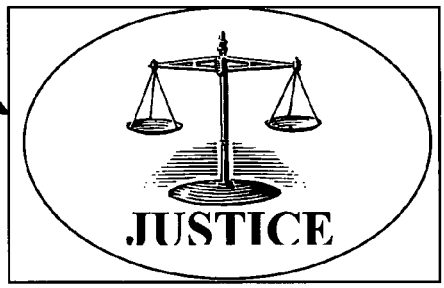
FIG. 11 represents the JUSTICE cards.
Figure 12:
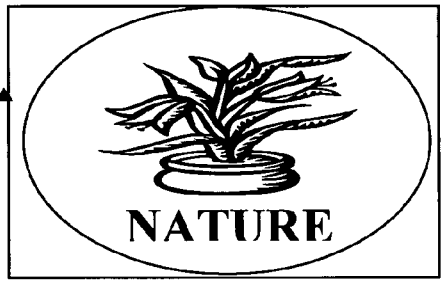
FIG. 12 represents the NATURE cards.

The board outer section 2 for placing the group cards 6-12, as show in FIG. 11, is mainly of a square shape with the track 3 placed in the middle. The four main groups of cards are located in specific spaces 6A-12A outside and around the track 3. In the instant case the Pandora's cards are divided in two sections of three subgroups. The two Pandora's cards sections are parallel to each other with the track 3 between the two Pandora's cards sections. The Ludus' cards are divided in two groups parallel to each other with the track 3 between them and perpendicular to the Pandora's cards. The ORACLE and CHANCE are aligned with each of the Pandora's cards section respectively as shown in FIG. 11. Each card group comprises several cards per group and subgroup. As shown in FIGS. 13-17, one side of the card shows the group/subgroup that belongs and on the other side shows a phrase with instruction at the bottom indicating some financial or other penalty or benefits. The cards 6-12 have been equally divided 50/50, pro and con, for us and against us. Therefore, before placing the CARDS in their appropriate locations or space 6A-12A they should be shuffled, divided and only part of the cards placed on each particular space 6A-12A.

The present game is a competitive game and the equipment for playing was disclosed above which is suitable for 1 or more players. Therefore how to play and the rules of the game are provided next for a better understanding of the game.

Rules of the Game

Multiple Players

One of the players is designated to manage the community money or chips. Each player or citizen starts the game by throwing a single die in order to establish his/her beginning SOCIAL STATUS Level

I-II-III-IV-V-VI

The number of players may vary but two to six players have been found the most desirable. Citizens will receive the appropriate social class status figure which they will place at a center point 4*a* where all the inner tracks accesses 5 are connected. For example, in the preferred embodiment, as shown in FIG. 1, all the players' figures are placed in the center point 4*a* which shows a social class status VI at the middle of the board.

Citizens receive $10,000 per STATUS level from the community money, for example:

I=$10,000

III=$30,000

VI=$60,000

The highest SOCIAL STATUS Citizen goes first. In case there is more than one player with the highest social status, the player who threw the highest social status first starts. They must indicate the direction and turn before throwing the pair of dice. The player advances the segments 4 that the dice indicates in the pre-selected direction. Each time a player lands on a new segment 4 he or she must follow the instruction related to that specific segment 4. For example, if a player lands on a segment 4 showing a social class level which is different from his/her actual social class, the player automatically changes his/her social status by exchanging their status figures for the new social status figure. In case he/she lands on a segment 4 having instructions or if he/she lands on a card representation segment 4, he/she picks up the top card of the card group deck related to the card representation segment and follows the instructions.

All other Citizens will follow in a counter clockwise rotation (to the left of the starting player), irrespective of their SOCIAL STATUS ranking. At the beginning of each turn all players must state the direction he/she is moving before throwing the pair of dice.

If a player forgets to indicate their intention, as to the direction and turn they are to take before throwing the dice, they lose their turn and must give $2,000 to the player that brought it to their attention.

When a player lands at the same track segment 4 of another player, the lower social class status player has been hit and must pay $20,000 in ransom money to the higher social class status player standing at the same segment. In case the player is located at a segment 4 showing a social class level and another player lands on the same segment, the player of lower social class status must pay the ransom money to the higher social class status player and no change of status is perform.

The Citizen who has been "HIT" continues playing only if he/she can pay the full ransom. If he/she cannot afford to pay the ransom debt, he/she loses and is removed from the game. Whatever special privilege cards or other property he/she has belongs to the player who "hits" him/her.

Only Citizens who have been "HIT" and can fulfill their obligations with money, special privilege cards, the Barter System, Insurance Policy, or giving other possessions, can remain in the game.

Once the game is in progress, it is the objective of each Citizen to:

1. Achieve the highest Social Status level
2. Avoid being "HIT" by a HIGHER STATUS player.
3. Try to "HIT" lower SOCIAL STATUS players.
4. Avoid landing on Lower SOCIAL STATUS areas.
5. Try to get SPECIAL PRIVILEGE cards.
(The Chiefs, Wizards or God-Fathers of the SECRET SOCIETIES)
6. Protect yourself at all times—Buy Insurance
7. Fulfill all of your obligations.
8. Amass a large financial fortune—chips.
9. Try to form ALLIANCES cooperation, with other Citizens in order to compete with a highest social class player in the neighborhood.
10. Citizens can try to barter, exchange whatever Special Privileges they may have in order to survive and remain in the game.

During the game, each player must be able to complete what PANDORA'S problems they have been given. They must be able to overcome conflict situations (obstacles). Each player must be able to resolve his/her own circumstances, while at the same time surviving the competition with their peers.

Social status VI Level:

In the present Game there can only be One SOCIAL STATUS VI player at a time. If at the beginning of the game two players throw a single die to the Level VI—the first player to do so is given the SOCIAL STATUS VI Trophy and money ($60,000)—the other player receives "compensation" of $5,000 and must throw again until they get a different social class status.

If while the game is in progress, one Citizen is a SOCIAL STATUS VI and another player lands on the Central Six (VI) Space 4*a*—that player will only receive "compensation" ($5,000)—but continues with his Status level.

Only when there are no other players with the SOCIAL STATUS VI, can a Citizen achieve a SOCIAL STATUS VI when they land on the Central VI Space 4*a*.

Jail:

When a Citizen lands on the JAIL Space they become an "INMATE". The INMATE has to immediately pay $5,000 to the Community Bank, and they also lose TWO (2) turns. While in JAIL, serving out their sentence, any HIGHER SOCIAL STATUS Citizen can "HIT" them. The INMATE has to pay the $20,000 RANSOM Debt. If they cannot comply with their Obligations the INMATE loses the game.

Citizens who throw a DOUBLE, and land on the JAIL space, are only "Visiting" the INMATES in JAIL. After their Visit, they throw the dice and continue on their journey through LIFE. Also if a Citizen is already in jail and any lower social class player lands at the jail segment, the lower social class player is only "visiting" the inmates in jail and stays there waiting for his/her next turn without penalties.

Special Rules

At the beginning of the game players can omit some of the following special rules so as to simplify the game. As these players become more competent in their understanding of the Underlying Game Dynamics, they can add their combinations for a more complex game.

Casino Royale:

Before the game begins the players have a GENTLEMEN'S AGREEMENT, that the FIRST Citizen to achieve a SOCIAL STATUS VI level is to receive TWO times (2×) the allocated amount of $60,000 to $120,000, on the first throw of the single die. In case no player achieves a social class VI at the beginning, the FIRST player who achieves the STATUS VI level during the game will receive $60,000. This GENTLEMEN'S AGREEMENT only applies to the FIRST Citizen who achieves the SOCIAL STATUS VI level.

Doubles:

Each time a Citizen throws a DOUBLE on the dice they receives $2000 and then take another turn. The Citizen receives the money, accomplishes what the segment 4 indicates, and then goes again.

When a Citizen throws a DOUBLE SIX (6:6) or a DOUBLE ONE (Snake-Eyes), they receive $5,000.

When a Citizen throws a DOUBLE and lands on the JAIL Space—they are only Visiting—These Citizens receive their money, throws again, and continues on their journey.

Alliances:

When there is an Overwhelming competitor in the Game—a SOCIAL STATUS VI, who is "Rich and Famous," part of the "400 CLUB, a Super Citizen, the other players may find it to their advantage to team up and form ALLIANCES following the credo of "THE ENEMY OF MY ENEMY IS MY FRIEND".

These disadvantaged competitors could form ALLIANCES. They could focus all of their energies on the "Heavy-Weight" and leave each other alone by:

Not "HITTING" each other

Enticing the "Heavy-Weight" to fall into traps

Naturally, these ALLIANCES may be only a momentary coming together, to surmount the "CLEAR AND PRESENT DANGER".

The Power Factor Cube:

Individual Citizens can augment their Risk-Benefits by utilizing the POWER FACTOR CUBE. Before throwing the set of dice the citizen has the choice of throwing the POWER FACTOR CUBE. The resulting POWER FACTOR CUBE number represents the amount of Risk-Benefit they wish to take, from 1-6. After moving, the Citizen either the amount of money he/she is about to WIN OR LOSE is multiplied by the POWER FACTOR CUBE number. This strategy is a possible path UP towards "QUICK RICHES", or a lonely road DOWN towards "RAGS" and "Giving up the Ghost".

The Ying-Yang Betting System:

Citizens can place an UNLIMITED Amount of money, on SIDE BETS, on whether the next role of the dice will be an ODD or EVEN Number, prior to throwing the dice.

The Citizens WINS or LOSES according to the outcome.

Immortality Card:

There is one immortality card in this game. The immortality card is part of Chance group cards and has the same benefits of the insurance card plus more. This card helps the player against all catastrophic events such as being hit, annihilation, changing social class or not having enough money to pay a debt. In case of annihilation the card can be used to become The World's Savior. In this case the player receives a payment of $30,000.

When a social class status VI citizen has the immortality card they become part of the "400 CLUB" and reside on Mount OLYMPUS with the other Deities. They can not lose their social class status if they land on the segment showing a lower class status level. Only if a social class status VI player picks up an APOCALYPSES Card from the Pandora's cards 10 he/she becomes mortal and is destroyed. The citizen is automatically out of the game. All of their Possessions are equally distributed among the other Citizens.

Buying Protection Insurance:

The insurance card works against some catastrophic events in order to survive life's uncertainties. A Citizen buys an INSURANCE Policy, in advance, against the possibility that some extreme event will harm them. This is providing a Protective Shield, Umbrella, or Buffer for a possible "Rainy Day" in the future.

The Citizen pays Premiums of $7,000, for an INSURANCE Policy, for any possible extreme event—being "HIT", going to JAIL and any payments to others. There are only five insurance cards. At the beginning of the game the insurance cards are offer in a counter clockwise rotation starting from the highest social class player. Each player can only have or use the insurance card once during the game. In case a player has more than one insurance card he/she has to exchange for $7,000 dollars from the community money. Any player can buy the insurance card at any moment of the game but only when it is his/her turn.

In the event a player is hit by a higher social class player and can not pay the debt the insured citizen or player gives up the insurance card to the higher class player in lieu of the catastrophic payment. Thus the victim is saved from being out of the game.

Secret Societies:

There are FIVE different groups of SECRET SOCIETIES.

Each Group has its Organizational Chief or Wizard. All of the cards Chiefs of these Secret GROUPS are located in the VIP ZONE.

The CLAN with its GRAND MASTER
The FAMILY with its GOD FATHER
The MEMBERS with its PREACHER
The COMPANY with its BOSS-MAN
The ESPIONAGE with its MASTER SPY A Citizen becomes Chief or Grand Wizard by selecting the VIP card which has that designation. The Citizen holds the card until another player picks up a card from the card groups 6-12 which shows his/her secret society. At this moment the secret society is "activated". When a secret player is "activated" the player holding the chief card receives the monetary premiums designated by the card augmented by THREE (3×). For example, if the card indicates that the player wins 1,000 dollars the player holding the chief card will receive 3,000 from the community money instead of the player who picked up the card or if the card indicates that the player loses $1,000 the player who picked up the card must pay 3,000 to the player holding the chief card. Each deck of cards per group/subgroups has at least one card from each of the Five Secret Groups in the card groups 6-12.

Annihilation Card:

There are Two ANNIHILATION Cards in this Game. One is in the CHANCE Zone (Volcanic Eruptions) and the other is in the NATURE Zone (Meteoric Impact). These are Total ANNIHILATION Cards. When these cards are uncovered, the Game Stops. Then the following procedure goes into effect:

The Citizen who drew the Annihilation Card goes first. They try to save Humanity.
The Citizen plays the dice game, and rolls the dice according to that Game.
If on the First roll they hit a SEVEN, they WIN and Humanity is saved.
If they roll Snake-eyes (1:1), they LOSE and the next Citizen attempts to become The World's Savior.
If a Citizen Rolls a Number and "makes the Number"—they WIN.
If the Citizen doesn't make their Number before rolling a SEVEN, they LOSE.
Then the next Citizen attempts to Save Humanity.
If all Citizens Lose in their attempts to SAVE Humanity, the Game is OVER. There is Total ANNIHILATION, with No survivors unless a player has the IMMORTALITY card.
However, if a Citizen WINS in their attempt to Save Humanity, that Citizen will receive $50,000 and an increase of two social statuses.
At anytime, prior to the beginning the Game, the ANNIHILATION Cards may be removed from the Game.

Winning the Game:

The winner is the last player standing, the Citizen who has been able to fulfill all of their SOCIAL OBLIGATIONS, but has also been able to out maneuver all of his/her competitors.

Single Player

Ludus Solitaire—Medusa's Web

On the single player mode, also called Medusa's web, basically the single player is fighting alone against a permanent higher class enemy. The permanent higher class enemy is PANDORA which starts the game as a Level VI. She receives her social class VI representation but doesn't need MONEY, for she has "all the money in the world". PANDORA is represented by MEDUSA. MEDUSA, as PANDORA'S emissary, starts first at the Central Level VI space.

Since MEDUSA is part of PANDORA'S System, all of the Cards Status Symbols do not affect her. Also because you are in mortal combat with her, your interest is to find the Olympian shield (HOLD Card) in the System. Only eight Olympian shield cards are used in the game wherein each one is located in the Pandora's cards, Chance and Oracle groups respectively. Money, status, and relationships are of no interest to you. However the player has to follow the instructions on the track segments. Your need is to SURVIVE your confrontation with MEDUSA.

Rules for Single Player

Once you are in MEDUSA'S WEB the following may happen:

If MEDUSA "HITS" you—you are DEAD. You lose.

If MEDUSA lands ONE space from you, you are FROZEN, She has TWO turns to "HIT" you.

If you land ONE space from her you are FROZEN, and she has TWO chances to come after you.

If you land directly in her space, without a Protective SHIELD you are DEAD.

If She "HITS" you even if you have a SHIELD, you are DEAD.

You can WIN only if you have a Protective SHIELD and "HIT" her first, then you can kill MEDUSA.

As you are trying to evade MEDUSA in her SPIDER-WEB, you will find many Treasures and worldly Possessions of previous VISITORS, but they are of no interest for you.

These are only Distractions to Lull you into Greed and Satisfaction. Your Goal—Directed Striving is to find your Holy Grail, the OLYMPIAN SHIELD, with which to KILL the dreaded MEDUSA.

We should note that consciously you are the Ambassador of Fate, therefore, make the best decisions for Pandora and her emissary Medusa. However, unconsciously you are representing your amorphous psyche, which is fighting Pandora.

In Reality, this is a confrontation between the basic elements of the Individual Unconscious (the SELF) against the Collective Unconscious (SOCIETY). When the Game begins, the die has been cast and your individual fight begins. You can rebel and confront destiny.

One will notice that the more one plays, the greater awareness one acquires about the complexities of Modern Living, and how interdependent we are with our environment. To acquire mastery of the game one should play numerous times, at different levels of complexities. In this manner we may learn the fine art of the "Juggling Act" needed to refine our behavior and movements in the Real World. For Beginners, the game can be played in a Simplified Format. That is, playing without the multiple Permutations and Combinations of LIFE'S complexities. All of those annoying, fuzzy, irritations of the Real World can be avoided by omitting the following modifications:

Casino Royale—The Yin-Yang betting system—Doubles—The Solitaire Dance in MEDUSA'S Web—The Power Factor Cube—The Secret Societies—and the Annihilation Game.

All the rules are disclosed in a manual. Also a guide with a summary of the rules for an easy understanding is provided to the players. As the Players become more sophisticated in their understanding of the dynamics of the present game invention, they can expand their Horizons and broaden their Scope of Gamesmanship. Later the players can include all of those Themes and Variations of LIFE'S Complexities. The Game then becomes a True test of the Player's Comprehension and dexterity.

Finally, one last Element is necessary in mastering the game. In order to become proficient, the Citizen must learn to WIN in the Shortest Time Frame possible so as to be considered the Ultimate Master of the Universe.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent functions.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. A board game for creating awareness of the different social classes, comprising:

a board wherein said board comprises a centered segment, a continuous outer track, several alternative inner accesses, a plurality of card group spaces and several card's groups wherein said continuous outer track comprises a first path of consecutive segments connected defining playing positions of a loop, wherein each consecutive segment bears a indicia, wherein said indicia is selected from a group of instructions, levels representations comprising a image of a particular level and card groups representations comprising illustration identifying at least one of card's groups, wherein the segments bearing a level representation at the continuous outer track are spaced apart by segments, wherein each segment spacing apart bears a indicia selected from said group of instructions and card group representations; and the same level representation is repeated at least ones on said first path, wherein the segments bearing a instruction at the continuous outer track are spaced apart by segments, wherein each segment spacing apart bears a indicia selected from said group of level representation and card group representations, wherein said centered segment is the only segment with at least four alternative paths, bears the highest level representation and is surrounded by the continuous outer track, wherein each inner access comprises at least a segment bearing a level representation and said inner access extends from the centered segment toward the inner boundaries of the continues outer track connecting with at least one of the consecutive segments of said continuous outer track providing alternative paths, wherein the plurality of card groups spaces are located outside of the continues outer track and indicates the position of each particular card group, wherein each card group comprises several cards bearing instructions and phrases thereon, so that when a player lands on a track segment showing a card group representation said player pick a card from the card group related to that card group representation, a plurality of players' representations figures, wherein said figures are shaped differently identifying the level, a pair of dice for producing a random count to determine the movement for said figures, and chips of different denomination as money representation.

2. A board game as set forth in claim 1, further comprising means for increasing players risks for winning or losing money, wherein said means for increasing players risks comprises a shaped figure having different sides and characters on each side to represent the amount of increment.

3. A board game as set forth in claim 1, wherein the level representation comprises social class having at least six different social class levels, wherein each level has a designated figure.

4. A board game as set forth in claim 1, wherein the center segment is a segment showing the highest social class level.

5. A board game as set forth in claim 1, wherein the continuous track has a hexagonal shape and four inner accesses.

6. A board game as set forth in claim 1, further comprising a multi-player playing mode and a single player mode.

7. A board game as set forth in claim 1, further comprising a multi-player playing mode and a single player mode, wherein the multiplayer mode comprise the steps of:

a. assigning a banker;

b. assigning through aleatory means a level for each player from a group of predetermined levels;

c. assigning a figure to each player depending on the level and placing said figure at the center segment;

d. assigning chips to each player depending on the level;

e. determining the order in which the players are going to participate starting from the highest level;

f. determining the direction to move the figure at the beginning of each player turn;

g. advancing said figures over a plurality of predefined segments according to the throw of the dice, said segments being associated with instructions providing awards and penalties for players landing in said segments, wherein a predetermined number of said segments include instructions, instructions to draw a card from one of the plurality of card groups and instructions to change the level status;

h. advancing said figures over a plurality of predefined segments according to the throw of the dice in direction of a lower social class player in order to land in the same segment and claim a ransom.

i. determining a factor risk or benefit through aleatory means at the beginning of each player turn.

j. determining side chip bets at the beginning of each player turn.

8. A board game as set forth in claim 1, further comprising a multi-player playing mode and a single player mode, wherein the single-player mode comprise the steps of:

a. assigning one of the figures to represent permanent higher level;

b. assigning one of the figures to represent the player;

c. placing said figures at the center segment at the beginning of the game;

d. determining the direction to move the figure at the beginning of each player turn;

e. advancing said figures over a plurality of predefined segments according to the throw of the dice, said segments being associated with instructions providing awards and penalties for the player landing in said segments, wherein a predetermined number of said segments include instructions and instructions to draw a card from one of the plurality of card groups and find the Olympian Shield card;

f. advancing Medusa over a plurality of predefined segments according to the throw of the dice in direction of the player in order to land in the same segment and destroy the player;

g. advancing said figures over a plurality of predefined segments according to the throw of the dice in direction of Medusa in order to land in the same segment and destroy Medusa after finding the Olympian shield.

9. A board game as set forth in claim 2, wherein said element for increasing players risks comprises a cube having different numbers bearing on each cube side.

* * * * *